US005133670A

United States Patent [19]

Doi et al.

[11] Patent Number: 5,133,670

[45] Date of Patent: Jul. 28, 1992

[54] SURFACE MOUNT CONNECTOR WITH CONTACT ALIGNING MEMBER

[75] Inventors: Etsuro Doi; Kiyoshi Atoh; Mutsuo Hatanaka, all of Tama, Japan

[73] Assignee: Kel Corporation, Tokyo, Japan

[21] Appl. No.: 670,793

[22] Filed: Mar. 18, 1991

[51] Int. Cl.[5] ..... H01R 9/09

[52] U.S. Cl. ..... 439/79; 439/76; 29/883; 29/837

[58] Field of Search ..... 439/76, 78-83, 439/606, 876; 29/834, 835, 837-839, 883

[56] References Cited

U.S. PATENT DOCUMENTS

| | | | |
|---|---|---|---|
| 3,993,382 | 11/1976 | Brown | 439/79 |
| 4,547,964 | 10/1985 | Amano et al. | 29/883 |
| 4,793,816 | 12/1988 | Pittman et al. | 439/79 |
| 4,955,819 | 9/1990 | Harting et al. | 439/79 |
| 4,964,806 | 10/1990 | Sakamoto et al. | 439/79 |
| 5,080,596 | 1/1992 | Viselli et al. | 439/79 |

*Primary Examiner*—Paula A. Bradley
*Attorney, Agent, or Firm*—Robert W. J. Usher

[57] ABSTRACT

A surface mount connector comprises an insulating housing body in which a series of electrical contacts are secured with contact leg portions thereof extending externally alongside a housing face and a contact aligning member for assembly with the housing by forcible insertion between the housing face and the contact leg portions thereby urging the contact leg portions away from the housing face to bring contact ends thereof into a common circuit board engaging plane and a predetermined spaced apart relation. The guide means comprises an insulating bar formed with a row of ribs defining between them contact receiving alignment channels at the predetermined spacing. Ears extend from the housing face at respective opposite ends of the series of contacts and have respective recesses aligned with each other and the contact leg portions for receiving the aligning member as a force fit to assemble the aligning member with the housing.

14 Claims, 3 Drawing Sheets

SURFACE MOUNT CONNECTOR WITH CONTACT ALIGNING MEMBER

FIELD OF THE INVENTION

The invention relates to a surface mount connector with a contact aligning member.

BACKGROUND OF THE INVENTION

Conventional surface mount connectors are frequently of the type in which a contact leg extending from a housing is cranked to provide a portion extending downwardly towards a circuit board and a transverse free contact end portion or foot intended to extend parallel to the circuit board for soldering to a contact pad thereof.

In view of the increasing complexity and microminiaturization of electronic devices, contact portions of such surface mount connectors must be both very narrow and closely pitched for accurate alignment and connection to the very closely spaced contact pads on the circuit board.

However, the consequently fragile contact legs are easily deformed during manufacture or handling causing undesirable displacement both from a suitable circuit board engaging plane and in relation to adjacent contact ends or feet with consequential risk of misalignment with the respective solder pads resulting in risk of poor connection and the formation of solder bridges. For example, adjacent contacts may be bent towards each other while the feet may not be sufficiently horizontal for effective engagement with the contact pads.

Notwithstanding the above requirement for precision, economy of manufacture mandates that the surface mount connectors be manufactured using mass production techniques which may further increase the risk of contact misalignment.

SUMMARY OF THE INVENTION

It is an object of the invention to provide a surface mount electrical connector having a contact aligning member for aligning and maintaining respective contacts in precise predetermined positions for accurate connection to contact pads of a circuit board.

More particularly, according to one aspect of the invention, a surface mount electrical connector comprises an insulating housing body having a first, lower, circuit board engaging face and a second face extending upwardly of the circuit board engaging face; a series of electrical contacts having respective anchoring portions secured in the housing body and respective resilient leg portions extending downwardly, externally of the housing body, and adjacent the second face towards the circuit board engaging face with contact ends thereof adjacent a plane containing the circuit board engaging face; an insulating contact aligning member formed with contact guide means; and, means for assembling the aligning member with the housing by forcible insertion of the aligning member between the contact leg portions and the second face with engagement between the contact guide means and the leg portions producing resilient flexure of the leg portions away from the second face, thereby bringing the free contact ends into precise coplanar relation at a predetermined spacing apart from each other.

Preferably, the guide means comprises a row of ribs defining between them contact receiving alignment channels at the predetermined spacing.

Thus, the contact end portions or feet can be precisely aligned quickly and easily merely by the simple step of assembling the aligning member with the connector housing. Furthermore, the aligning member is extremely inexpensive to manufacture and occupies substantially no additional circuit board space. The connector housing may be of simple shape without a requirement for precisely configured contact guiding channels facilitating manufacture by relatively fast molding processes requiring only relatively simple and inexpensive tooling.

The presence of the aligning member also reinforces the circuit board mounted connector while the prestressed condition of the contacts prevents undesirable play when mounting the connector on the circuit board or during the soldering step further reducing the risk of dislocation, poor connection and the formation of solder bridges.

According to another aspect of the invention, there is provided a method of manufacturing a surface mount electrical connector by in-molding a series of contact precursors attached to a carrier strip with a insulating housing body formed with a lower circuit board engaging face and a lateral face extending upwardly therefrom, the contact precursors being in-molded with leg precursors extending externally, in substantially coplanar relation, from the lateral face of the housing body to the carrier strip; severing individual contact leg precursors from the carrier strip and bending the leg precursors to provide a respective contact leg portions extending downwardly adjacent the lateral face towards the circuit board engaging face and respective contact foot portions extending transversely from respective free ends of respective contact leg portions and spaced from a circuit board engaging plane; providing an insulating aligning member having contact guide means and forcibly inserting the aligning member between the contact legs and the lateral face thereby bringing the contact guide means into engagement with respective contact legs thereby flexing the contact legs away from the lateral face to move the contact portions into coplanar, precisely spaced apart relation corresponding to locations of respective contact pads of a circuit board.

Thus, the economy of a gang in-molding technique is obtained while also maintaining extreme accuracy of contact alignment and consequential reliability of electrical connection.

According to a further aspect of the invention, there is provided a surface mount electrical connector comprising an insulating housing body; a plurality of electrical contacts having portions anchored in the body and respective contact leg portions extending from the body with respective free contact ends thereof spaced apart from each other; a contact aligning member for assembly with the housing body and engageable with respective contact legs during movement to an assembled condition thereby locating the respective contact ends into a common circuit board engaging plane.

Preferably, the contact ends are all spaced apart from the circuit board engaging plane prior to engagement with the aligning member and the contact legs are resiliently flexed by the engagement with the aligning member and assist in retaining the aligning member assembled with the housing body.

In one particular embodiment, the contact leg portions extend adjacent a housing face and the aligning member is forcibly inserted between the housing face and the contact legs causing resilient flexure of the contact legs away from the housing face during assembly with the housing body. The contact legs may be L-shaped with the feet forming the contact ends.

The aligning member has an elongate face formed with a series of ribs extending transversely thereof in longitudinally spaced apart relation defining between them contact leg receiving recesses and at least one recess on the housing receives the aligning member in an interference fit to retain the aligning member assembled therewith.

In a simple construction, ears extend from the housing face at respective opposite ends of the series of contacts two such recesses are formed in respective ears in alignment with each other.

According to a further aspect of the invention, a surface mount electrical connector comprises an insulating housing having a lower, circuit board engaging face and an adjacent face extending upwardly therefrom; a series of stamped and formed contacts comprising anchoring portions, leg portions extending therefrom and contact feet at free ends of respective leg portions; the anchoring portions being secured in the housing with respective leg portions extending externally down the adjacent housing face and located spaced apart from each other in a horizontally extending row; an aligning member press-fitted between respective contact leg portions and the adjacent housing face prestressing the contact leg portions away from the adjacent housing face and maintaining the respective contact feet in coplanar, precisely spaced apart relation.

BRIEF DESCRIPTION OF THE DRAWINGS

An example of a surface mount connector according to the invention will now be described with reference to the accompanying drawings in which.

The connector comprises a housing 11 molded in one piece from insulating plastic in which a series of contacts 12 are secured by an in-molding technique, a contact aligning member 13 for assembly with the housing and retaining plates 14, 14' for securing the connector housing to a circuit board.

Figure 1A:
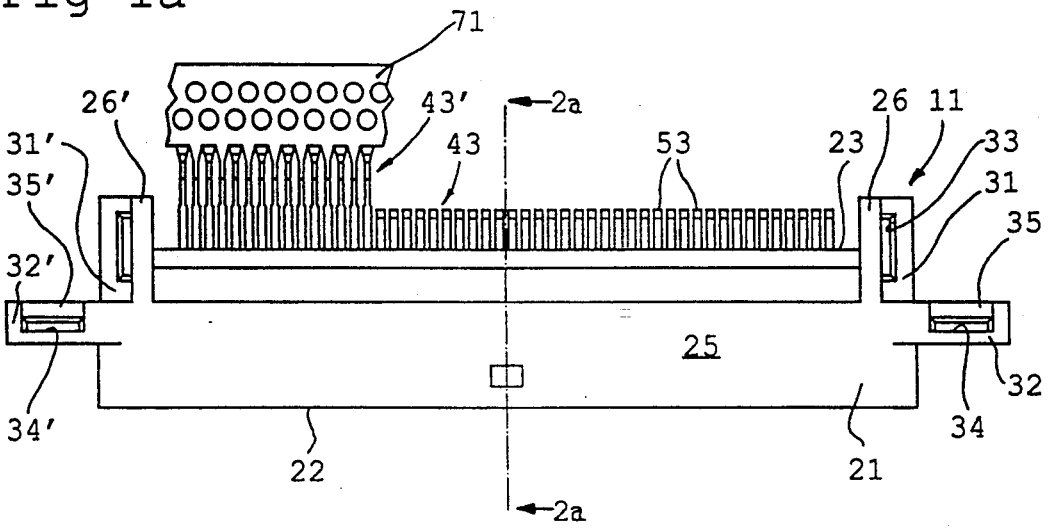
FIGS. 1(*a*), 1(*b*) and (*c*) are, respectively, plan, front and underplan views of the connector at a stage in manufacture.
Figure 1B:
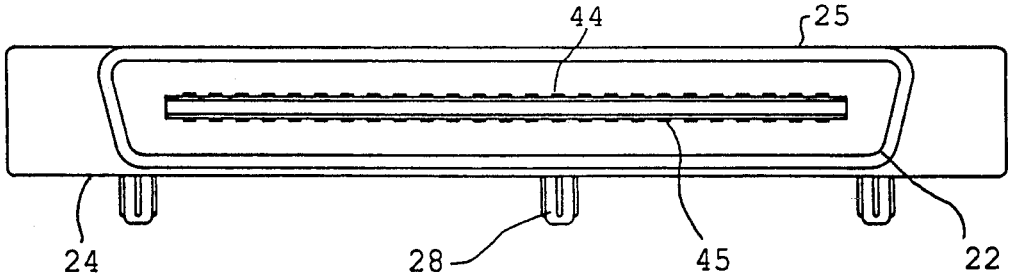
Figure 1C:
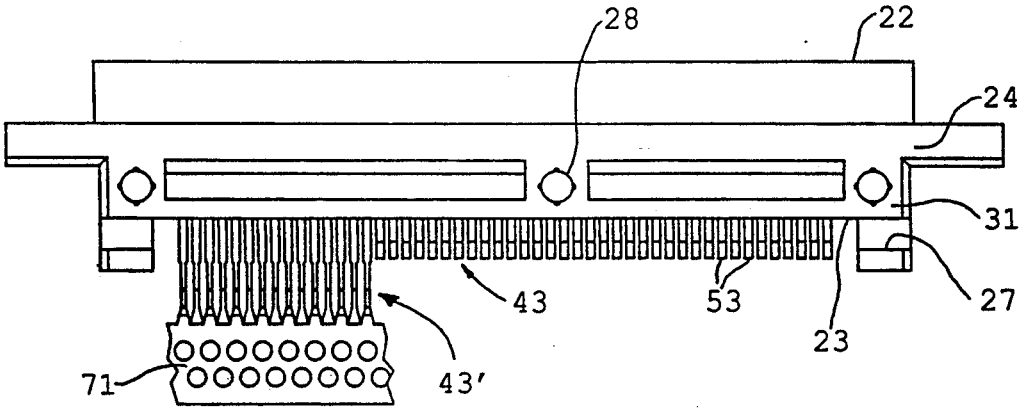
Figure 2A:
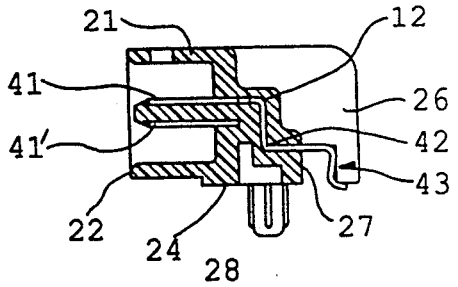
FIGS. 2(*a*) and 2(*b*) are cross-sectional views taken along a line corresponding to line 2—2 of FIG. 1(*a*), at a later manufacturing stage, after removal of the carrier strip, the latter being an enlarged fragmentary view.
Figure 2B:
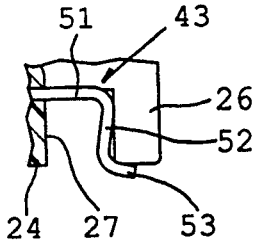
Figure 3A:
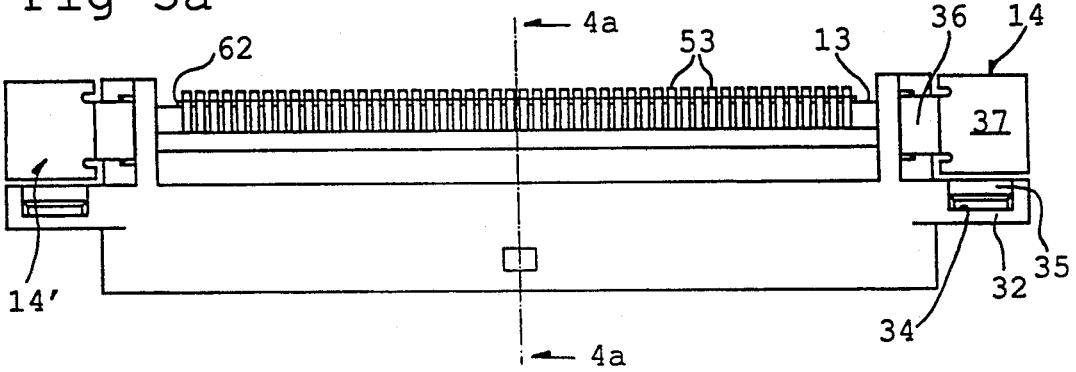
FIGS. 3(*a*) and 3(*b*) are plan and underplan views, respectively, of a fully assembled electrical connector.
Figure 3B:
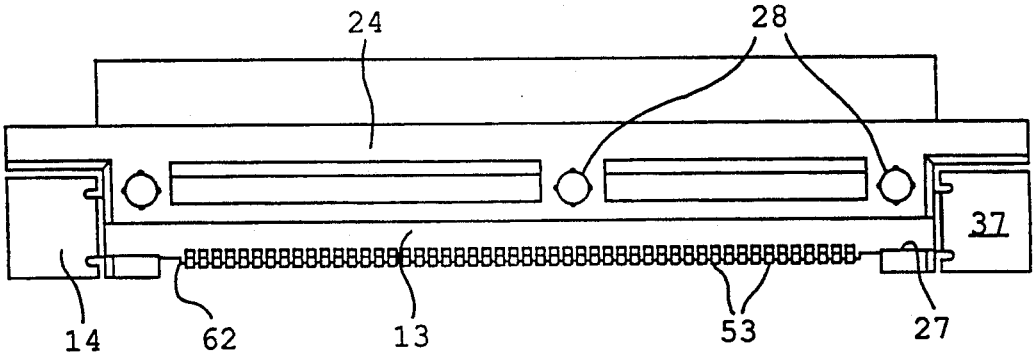
Figure 4A:
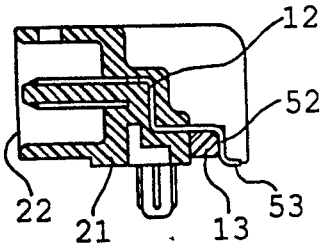
FIGS. 4(*a*), 4(*b*) and 4(*c*) are, respectively, a cross-sectional view taken along line 4—4 of FIG. 3(*a*), an end elevational view, and a corresponding elevational view with a retaining plate omitted.
Figure 4B:
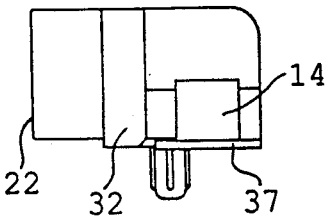
Figure 4C:
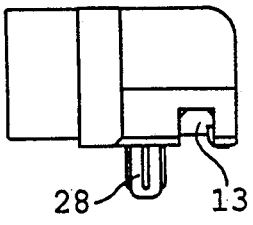
Figure 6:
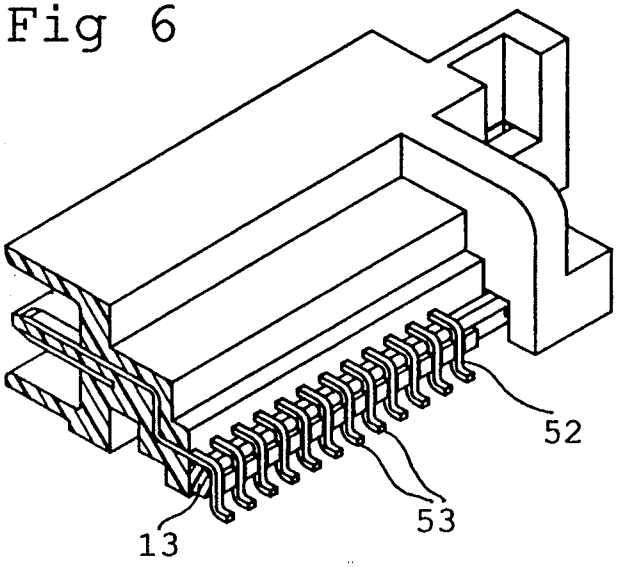
FIG. 6 is a similar view to FIG. 5 of the fully assembled connector; and, FIG. 7 is a perspective view of a retaining plate.
Figure 7:
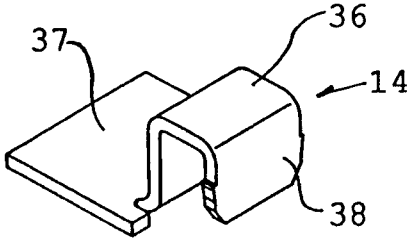

The housing 11 is of the type generally known as a right angled header and comprises an elongate body 21 having front and rear, mating and contact faces 22 and 23, respectively, a lower circuit board engaging face 24 extending therebetween and an upper face 25. As shown in FIG. 1(*a*), a pair of identical ears 26, 26' protrude rearwardly from the rear face 23 and are each formed with downwardly opening recesses 27 in longitudinal alignment for receiving and retaining the contact aligning member 13 in a lower part thereof adjacent the circuit board engaging face 24.

A pair of identical flanges 31, 31' extend in opposite longitudinal directions from lower parts of the respective ears 26, 26', each flange being formed with a blind ended retaining slot 33.

A further pair of ears 32, 32', identical to each other and formed with blind ended retaining slots 34, 34' extend longitudinally in opposite direction from opposite ends of the housing body 21. Rearwardly opening, vertically extending recesses 35, 35' of greater depth than the thickness of the retaining plate 14 are formed in respective ears 32, 32' for receiving a bridge portion 36 of the retaining plate which extends between a metal mounting plate section 37 and an ear section 38 which is receivable in any respective slot 34 or 34'.

The rear face 23 of the housing is stepped downwardly as it extends rearwardly. Connector locating pins 28 for receipt in apertures in a circuit board precisely to position the connector thereon, extend from the underside or lower face of the housing.

Each contact 12 is stamped and formed from sheet metal stock and comprises a flat mating portion 41 extending to the mating face 22, an anchoring portion 42 in-molded in the housing body and a contact leg portion 43 extending from the rear face 23. The mating portions 41, 41' are located at the mating face 23 in upper and lower rows 44 and 45, respectively, but the contacts of the lower row have intermediate portions which are pitch-changed with respect to those of the upper row so that leg portions 43 of the contacts of both rows extend from the rear face 23 as a single row pitched at double density. Each contact leg is bent through approximately 90° in opposite directions at two spaced apart locations forming a loop or crank profile, providing a first portion 51 extending laterally outwardly from the rear face 23, an intermediate portion 52 extending downwardly therefrom, spaced from and inclined towards the rear face and terminating in a transverse free contact end or foot 53. The inclination of the intermediate portion 52 is such that the contact foot is inclined to the plane of the circuit board engaging face with the tip of the contact foot protruding below such plane. The loops thus defined by the contact leg portions are aligned with respective recesses 27.

Figure 5:
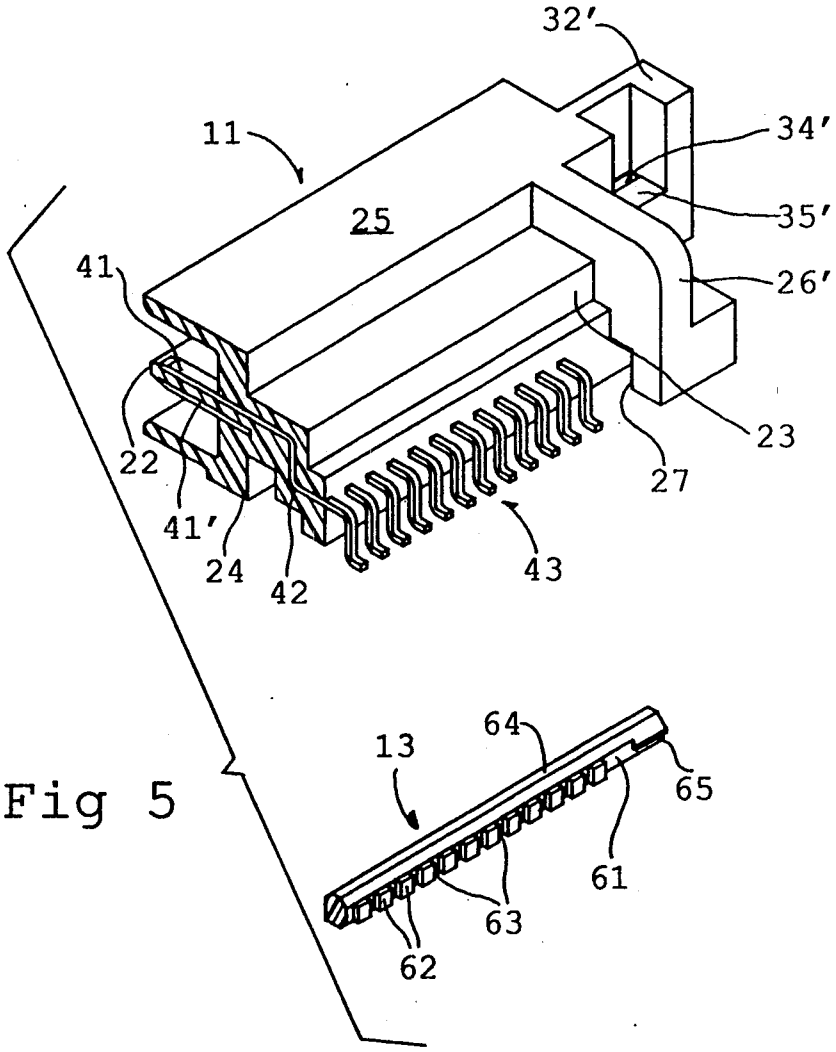
FIG. 5 is an exploded, schematic perspective view of a portion of the connector, partly in cross-section.

As best seen in FIG. 5, the aligning member 13 is a plastic bar having a guiding face 61 formed with a series of guiding ribs 62 located at equally spaced apart intervals therealong, adjacent ribs defining between them, vertically extending, contact leg receiving channels 63 spaced apart at intervals corresponding to the desired contact pitch. A leading upper edge 64 is tapered to afford easy insertion and retaining projections 65 are formed at respective opposite ends of the aligning member 13.

As shown in FIG. 1, during manufacture, the stamped and formed contacts 12 are molded in the housing body, gang-fashion, with the precursors 43' of respected contact legs extending in generally planar relation to the carrier strip 71 to which they are still attached and which is then progressively sheared away to separate, sequentially, individual contacts therefrom, the intermediate, downwardly extending portion of the contact leg and the transversely extending contact foot being formed immediately after severance.

The aligning member 13 is then forcibly inserted between the rear face of the housing and the contact leg portions until fully received in the recesses 27 as an interference fit. During insertion, the respective contact legs enter respective channels 63, flexing the downwardly extending, intermediate portions 52 away from the rear face of the housing to move the contact feet into precisely coplanar and precisely spaced apart relation for accurate engagement with respective pads on a circuit board with upward tilting of the tip of each foot to bring the foot into a more horizontal plane closely adjacent the circuit board engaging face of the housing.

The retaining plates 14 are then assembled with the housing by receipt of the respective ears 38 in respective slots 33, the plate portions 37 thereof subsequently being soldered to dummy pads of the circuit board.

The concept of the invention affords extreme economy of manufacture by a gang in-molding technique without requiring undue precautions for the protection of contacts against deformation handling while enabling precise contact aligning to be obtained at the very close pitch required by a very simple and rapid assembly step. The risk of inadvertent contact deformation is also reduced as the contacts end portions are located closely adjacent the housing during handling and are only bent outwardly therefrom to a more exposed location when supported by the aligning member.

Furthermore, substantially no additional circuit board space is required since the cranked or L-shape contact leg is conventional and the aligning member occupies an area otherwise not utilized.

The risk of unreliable connection arising from misalignment of the contact feet and pads of the circuit boar is significantly reduced as is the risk of solder bridges producing cross connection or short circuit. The physical presence of the aligning member after a connection may also desirably reinforce the circuit board mounted connector.

We claim:

1. A surface mount electrical connector comprising an insulating housing body having a first, lower, circuit board engaging face and a second face extending upwardly of the circuit board engaging face;

a series of electrical contacts having respective anchoring portions secured in the housing body and respective resilient leg portions extending downwardly, externally of the housing body, and adjacent the second face towards the circuit board engage face with contact ends thereof adjacent a plane containing the circuit board engaging face;

an insulating contact aligning member formed with contact guide means; and, means for assembling the aligning member with the housing by forcible insertion of the aligning member between the contact leg portions and the second face with engagement between the contact guide means and the leg portions producing resilient flexure of the leg portions away from the second face thereby bringing the free contact ends into precise coplanar relation at a predetermined spacing apart from each other.

2. A surface mount electrical connector according to claim 1 in which the guide means comprises a row of ribs defining between them contact receiving alignment channels at the predetermined spacing.

3. A method of manufacturing a surface mount electrical connector by in-molding a series of contact precursors attached to a carrier strip with a insulating housing body formed with a lower circuit board engaging face and a lateral face extending upwardly therefrom, the contact precursors being in-molded with leg precursors extending externally, in substantially coplanar relation, from the lateral face of the housing body to the carrier strip; severing individual contact leg precursors from the carrier strip and bending the leg precursors to provide a respective contact leg portions extending downwardly adjacent the lateral face towards the circuit board engaging face and respective contact foot portions extending transversely from respective free ends of respective contact leg portions and spaced from a circuit board engaging plane; providing an insulating aligning member having contact guide means and forcibly inserting the aligning member between the contact legs and the lateral face thereby bringing the contact guide means into engagement with respective contact legs thereby flexing the contact legs away from the lateral face to move the contact portions into coplanar, precisely spaced apart relation corresponding to locations of respective contact pads of a circuit board.

4. A surface mount electrical connector comprising:

an insulating housing body;

a plurality of electrical contacts having portions anchored in the body and respective contact leg portions extending from the body with respective free contact ends thereof spaced apart from each other;

a contact aligning member for assembly with the housing body and engageable with respective contact legs during movement of the contact aligning member to an assembled condition thereby locating the respective contact ends into a common circuit board engaging plane.

5. A surface mount electrical connector according to claim 4 in which the contact ends are all spaced apart from the circuit board engaging plane prior to engagement with the aligning member.

6. A surface mount electrical connector according to claim 5 in which the contact legs are resiliently flexed by the engagement with the aligning member and assist in retaining the aligning member assembled with the housing body.

7. A surface mount electrical connector according to claim 6 in which the contact legs are L-shaped with the feet forming the contact ends.

8. A surface mount electrical connector according to claim 6 in which the contact leg portions extend adjacent a housing face and the aligning member is forcibly inserted between the housing face and the contact legs causing resilient flexure of the contact legs away from the housing face during assembly with the housing body.

9. A surface mount electrical connector according to claim 8 in which the aligning member has an elongate face formed with a series of ribs extending transversely thereof in longitudinally spaced apart relation defining between them contact leg receiving recesses.

10. A surface mount electrical connector according to claim 9 in which means are provided on the housing to retain the aligning member assembled therewith.

11. A surface mount electrical connector according to claim 10 in which the housing retaining means comprises at least one recess receiving the aligning member in an interference fit.

12. A surface mount electrical connector according to claim 11 in which ears extend from the housing face at respective opposite ends of the series of contacts and said at least one recess comprises two recesses formed in respective ears in alignment with each other.

13. A surface mount electrical connector comprising:

an insulating housing have a lower, circuit board engaging face and ad adjacent face extending upwardly therefrom;

a series of stamped and formed contacts comprising anchoring portions, leg portions extending therefrom and contact feet at free ends of respective leg portions;

the anchoring portions being secured in the housing with respective leg portions extending externally down the adjacent housing face and located spaced apart from each other in a horizontally extending row;

an aligning member insertable in a direction longitudinally of the leg portions from free ends thereof between respective contact leg portions and the adjacent housing face for receipt as a press-fit therebetween prestressing the contact leg portions away from the adjacent housing face and maintaining the respective contact feet in coplanar, precisely spaced apart relation.

14. A surface mount electrical connector comprising an insulating housing body having a first, lower, circuit board engaging face and a second face extending upwardly of the circuit board engaging face;

a series of electrical contacts having respective anchoring portions secured in the housing body and respective resilient leg portions extending downwardly, externally of the housing body, and adjacent the second face towards the circuit board engaging face with contact ends thereof adjacent a plane containing the circuit board engaging face;

an elongate, plastic, insulating contact aligning member formed with transversely extending contact guide means for engagement with respective of the contact leg portions to bring the leg portions into precisely spaced apart relation; and means for assembling the aligning member with the housing by forcible insertion of the aligning member between the contact leg portions and the second face with engagement between the contact guide means and the leg portions producing resilient flexure of the leg portions away from the second face thereby bringing the free contact ends into precise coplanar relation at a predetermined spacing apart from each other.

* * * * *